US005232345A

United States Patent [19]

Rocco

[11] Patent Number: 5,232,345

[45] Date of Patent: Aug. 3, 1993

[54] FEATHERING PROPELLER WITH A MANUALLY ADJUSTABLE PITCH

[75] Inventor: Berghella Rocco, Solbiate Olona, Italy

[73] Assignee: Marine Propeller s.r.l. Costrusioni Eliche a Passo Variabile, Italy

[21] Appl. No.: 688,530

[22] PCT Filed: Mar. 19, 1990

[86] PCT No.: PCT/IT90/00030

§ 371 Date: Jun. 18, 1991

§ 102(e) Date: Jun. 18, 1991

[87] PCT Pub. No.: WO90/11221

PCT Pub. Date: Oct. 4, 1990

[30] Foreign Application Priority Data

Mar. 21, 1989 [IT] Italy ..... 83614 A/89
Jul. 14, 1989 [IT] Italy ..... 83630 A/89

[51] Int. Cl.[5] ..... B63H 1/06; B63H 3/04; B63H 3/12

[52] U.S. Cl. ..... 416/153; 416/61; 416/159; 416/245 A

[58] Field of Search ..... 416/61, 131, 140 R, 416/153, 205, 245 A, 147, 151, 159, 160

[56] References Cited

U.S. PATENT DOCUMENTS 3,275,083 9/1966 Allin ..... 416/149
3,294,175 12/1966 Bodner ..... 416/159
3,294,176 12/1966 Reimers .
3,308,889 3/1967 Langhjelm et al. ..... 416/140 R
3,403,735 10/1968 Langhjelm et al. ..... 416/140 R
3,415,324 12/1968 Austin, Jr. ..... 416/61
4,047,841 9/1977 Laurin .
4,140,434 2/1979 Bianchi .

FOREIGN PATENT DOCUMENTS 1066718 4/1967 United Kingdom .

*Primary Examiner*—Edward K. Look
*Assistant Examiner*—Christopher Verdier
*Attorney, Agent, or Firm*—Pollock, Vande Sande & Priddy

[57] ABSTRACT

Pitch adjustment in a feathering propeller employing a planet gear engagement between a pinion hub keyed on the drive shaft and planet pinions at the base of the blades of the propeller which are rotatably mounted through holes of the wall of a hub's casing may be easily performed manually by registering the relative angular position of a second portion of casing in respect to a first portion of the casing housing the planet gear. The registration of the pitch takes place by parting the second portion of casing from the first portion against the resistance of a push-back spring for a distance sufficient to disengage a coupling between the second portion and first portion of the casing or the pinion hub, rotating the second portion so disengaged in respect to the first portion of the casing before releasing the pull causing again the engagement of the two portions in a modified relative angular position. In this way the stop mechanisms for the travel of a dragging sector solidly connected to the hub of the propeller, which are substantially formed on the internal wall of the second portion of the casing, change their relative position about the sector thus modifying the limit orientation assumed by the blades when the drive shaft is rotated. Resilient elements are used between abutment surfaces for preventing deformation thereof.

8 Claims, 5 Drawing Sheets

FEATHERING PROPELLER WITH A MANUALLY ADJUSTABLE PITCH

BACKGROUND OF THE INVENTION

The present invention relates to a feathering propeller the pitch of which can be manually adjusted and which is particularly suited for sailing-boats.

The use of feathering propellers in sailing-boats for reducing drag when the boat is moving under sail is common.

On the other hand, in order to achieve the maximum efficiency in motor-driven motion, the propeller should be designed in function of the mechanical characteristics of the engine used (torque and power characteristics in function of the r.p.m. and of the engine's efficiency) as well as of the hydrodynamic characteristics of the boat's hull.

An effective answer to these problems is given by the so-called variable pitch propellers, i.e. propellers wherein the orientation of the blades when the propeller is driven by the engine may be adjusted, obviously within certain limits, to particular characteristics and/or conditions of use.

There is a category of commercially available propellers known as variable pitch, feathering propellers which fit in particular the needs of auxiliary engine propulsion systems for sailing-boats.

These known propellers commonly comprise a pinion-hub keyed by means of a conical key joint on a rotary drive shaft, said pinion-hub having a coaxial conical gear, at least two and more preferably three propeller blades, each having a conical planet pinion at the base thereof meshing with said conical gear of the pinion-hub, are journalled through a hub's casing free to rotate about the hub through a limited arc of circumference. Each blade is free to rotate about the axis of their conical pinion base in a planet-wise manner around said conical gear of the pinion-hub for two opposite angles (starting from a neutral position of the blade whereat the faces of the blade are substantially parallel to the axis of the propeller shaft) presettable by stop means, under the hydraulic forces caused, respectively, by the rotation in a forward drive sense and in a reverse drive sense of the drive shaft. These stops determine the pitch of the propeller in the two senses of rotation. The casing is formed by sectors joined together by means of tangential stud screws and houses the pinion-hub and the planet pinions of the blades, which are journalled through holes of the casing formed along the coupling faces of the sectors which form the casing. The latter may rotate about said pinion-hub through either of said two opposite angles, from said neutral position of the blades, together with a planet-wise rotation of the blades around said pinion-hub and about their own axis. The two opposite angles of rotation are preset by stop means which may be formed by a radially extending tooth or sector solidly connected to said casing cooperating with a radially extending tooth or sector solidly connected to the body of said pinion-hub so as to determine by abutment of one tooth with the other stops for both senses of relative rotation.

Propellers of this type are described in U.S. Pat. No. 4,047,841 and U.S. Pat. No. 4,140,434. In these known propellers the pitch could not be modified but through a complete disassembly of the propeller, thus requiring hoisting the boat and of the water for changing the pitch. In a prior Italian patent application No. 83647 A/87, filed on Aug. 11, 1987, assigned to the present applicant, a feathering propeller with a pitch adjustable without grounding the boat and without disassembling the propeller is described. The propeller disclosed in this prior application made use of a thimble meshing with an extremity of the body of said pinion-hub and held engaged therewith by a spring abutting against a closing flange of the casing of the propeller through which flange was mounted an ogive-shaped terminal having a central hole through which a stem solidly connected to said thimble could pass through and emerge from the apex of the ogive terminal. By means of a suitable key this stem could be pulled out in order to disengage said thimble from said pinion-hub and re-engage the thimble on the pinion-hub after having varied their relative angular position, thus changing the pitch of the propeller.

Also this propeller, though having advantages in respect to the previously known propellers, has the drawback of being necessarily disassembled in order to be mounted and dismantled from the drive shaft of the boat and moreover it is necessary to use a key for adjusting the pitch. Moreover as the other propeller of the prior art, the propeller generates a relatively high level of vibrations which fact is imputable in a large measure to the way the blades are journally mounted through the casing, whereby the flexural forces are borne by the tangential stud screws used for joining together the sectors which form the casing, moreover at start-up and reversal of the sense of rotation of the propeller, the casing dragging teeth, by ramming one against the other over said stop surfaces, generate a strong banging noise and a rapid wear of the abutment surfaces of said stops.

OBJECTIVES AND SUMMARY OF THE INVENTION

A main objective of the invention is to provide a feathering propeller, the pitch of which can be adjusted without requiring disassembly of the propeller and wherein the propeller may be mounted and dismantled from the drive shaft of the boat without the need for disassembling the propeller and wherein the blades are journally mounted through the wall of the hub's casing of the propeller in a way that prevents or substantially reduces the generation of vibrations.

A further objective of the invention is to provide a propeller wherein the ramming of one abutment stop surface against another is resiliently dampened.

In accordance with the present invention these objectives are reached by means of a propeller wherein the blades which terminate with a conical gear, planetarily engaging with the pinion-hub's conical gear, are no longer journally held into cylindrical sockets formed by joining together two adjacent sectors of the casing, but on the contrary each blade is solidly connected to the cylindrical stem of the respective conical pinion passing through a hole of the wall of the respective sector of the casing. In this way the flexural forces acting on the blade are borne by the body of the respective sector and are better distributed over the assembled casing than in propellers of the prior art. The use of precision machined conical pinions and not, as customary, of pinions directly machined on the integral cast body of the blade, permits to reduce clearances further and improves the vibration characteristics of the propeller.

The device for manually changing the pitch of the propeller without requiring tools is implemented by "segmenting" the hub's casing along the axis thereof, into a first portion rotatable in respect to the pinion-hub of the propeller and provided with holes through which rotatably pass the stems of the planet pinions of the blades of the propeller, and a second portion which is internally provided with stops for the relative angular travel of an engagement tooth or sector solidly connected to the pinion-hub in order to provide angularly spaced stops to a relative free rotation of the pinion-hub in respect to the hub's casing and viceversa. The second portion of the casing may be telescopically pulled away from the first portion of casing against the resistance of a push-back spring by a distance sufficient to disangage said second portion from said first portion of casing or from said pinion-hub which mesh together through an adjustable relative angular position coupling and the pull on the second portion of the casing may be reliesed after having rotated it relatively to the first portion of the casing for re-engaging it with the latter, having so changed the angles set by said stops.

The design position of the second portion of the casing in respect to the first portion containing the planet gear assembly of the feathering blades is reversible. The essentially tubular second segment of the casing, telescopically meshing with the first portion of the casing and provided with the engagement stops cooperating with the engagement tooth or sector solidly connected to the pinion-hub of the propeller may be formed on the side facing the drive shaft or toward an ogive-shaped terminal of the casing itself. In the first case the abutting surface for the push-back spring may be provided by a tubular flange mechanically mounted on the end of the pinion-hub body toward the drive shaft. In the second case, the ogive-shaped terminal itself, which can be connected to the rear end of the pinion-hub body of the propeller, houses the push-back spring which keeps the two other portions of the casing meshed together.

According to a further alternative embodiment of the propeller of the invention, a pitch adjustment thimble meshing with the pinion-hub is tubolarly extended and solidly connected to the ogive-shaped terminal of the propeller which may be manually pulled back by a distance sufficient to disengage the thimble from the pinion-hub in order to rotate it and re-engage it in a varied relative angular position for changing the pitch. The ogive-shaped terminal is further provided with a removable cap in order to gain access and unscrew a locking nut from a threaded end of the drive shaft, thus permitting to dismantle (and mount) the propeller from the drive shaft without disassembling it.

Moreover the wear of the abutment surfaces of the stops and of the engagement tooth is substantially eliminated by resiliently mounting said stops on the internal wall of one of the sectors forming the hub's casing in order to dampen the ramming together of the abutment surfaces.

BRIEF DESCRIPTION OF THE DRAWING

The different aspects and advantages of the propeller of the present invention will become more evident through the following detailed description of several preferred embodiments, shown in the appended drawings, wherein.

DESCRIPTION OF THE PREFERRED EMBODIMENT

Figure 1:
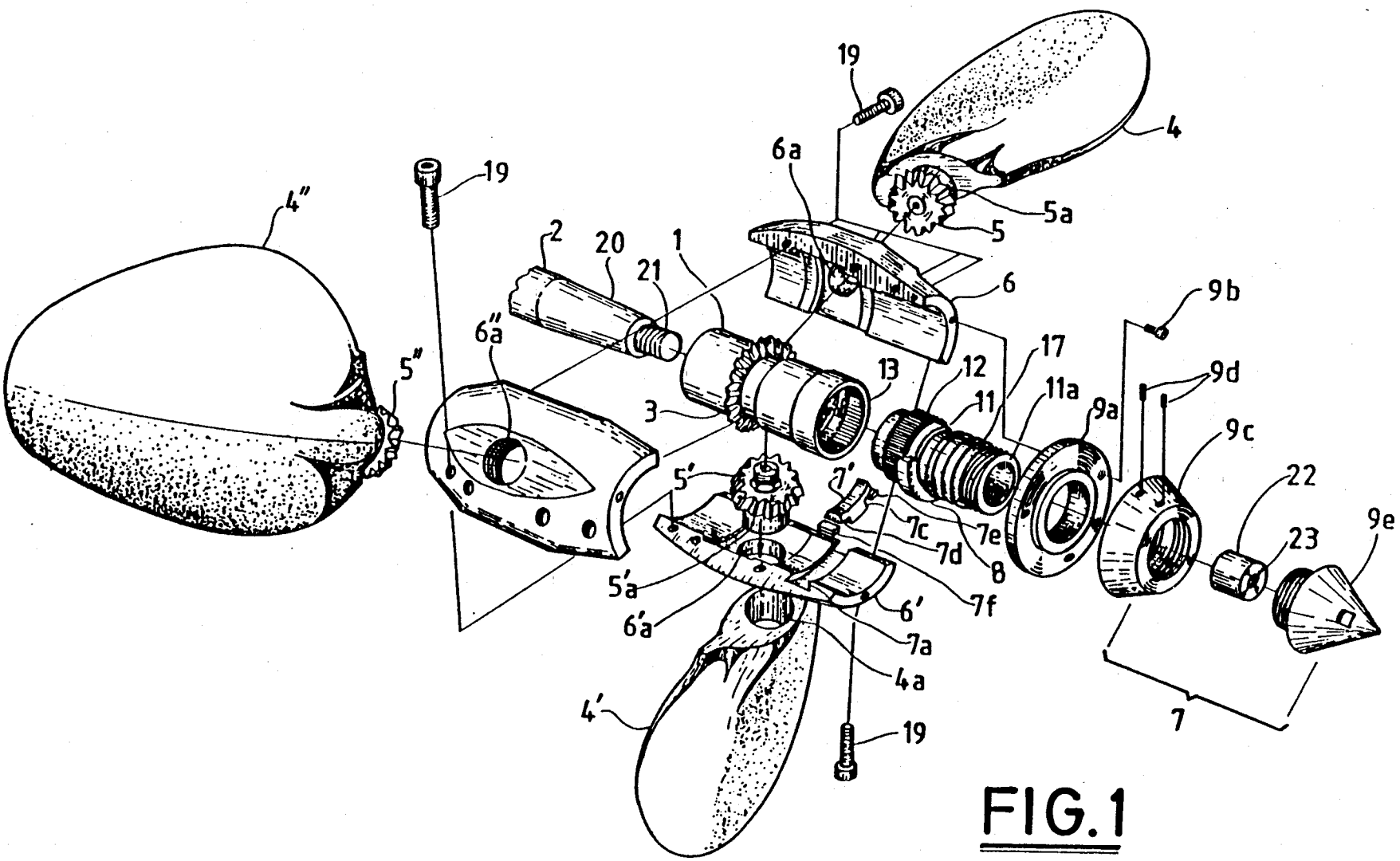
FIG. 1 is an exploded view of a propeller of the invention according to a first embodiment.
Figure 1A:
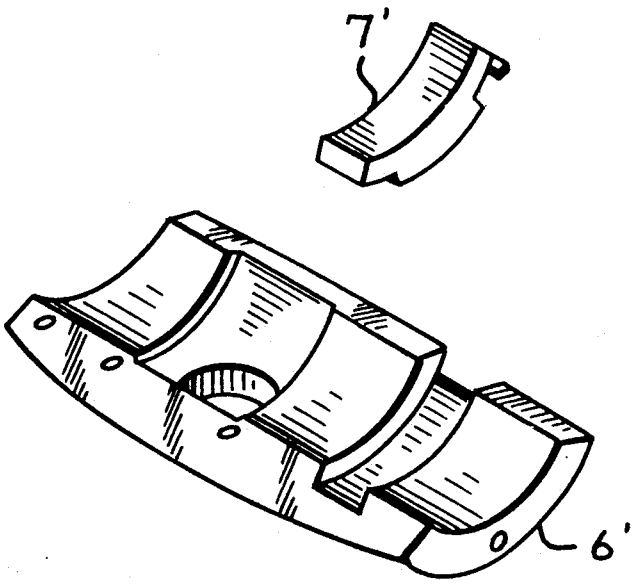
FIG. 1*a* is an enlarged view of the elements which transfer motion from a hub tooth to the blades of the propeller.
Figure 2:
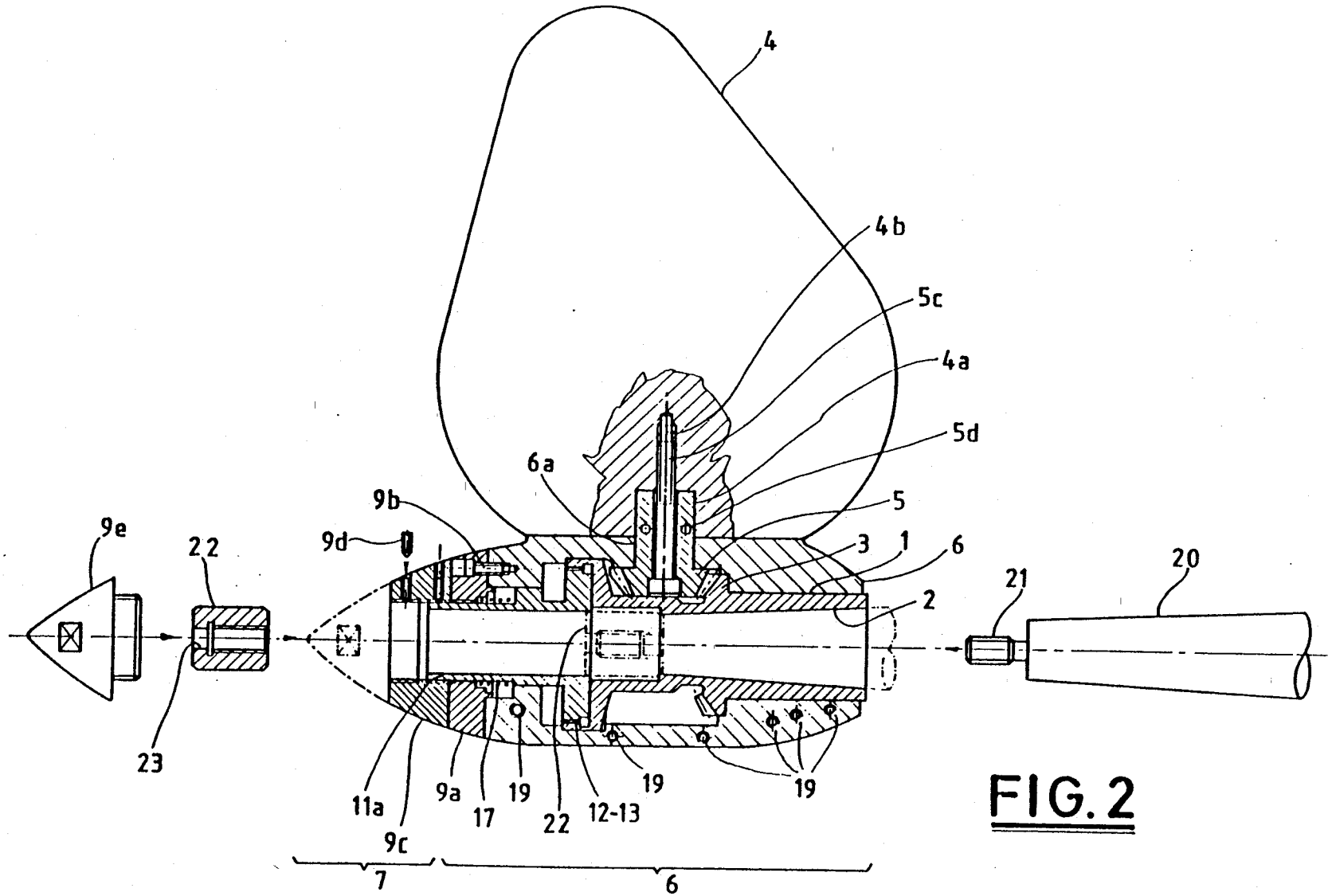
FIG. 2 is a partial cross-sectional view of the propeller of FIG. 1.

A first embodiment is shown in FIGS. 1 and 2. The propeller comprises a pinion-hub 1. The pinion-hub 1 has a conical seat with a key (the latter is not shown in the figures) for receiving the conical end 20 of a drive shaft 2 having a threaded end 21 on which a locking ring nut 22, provided with a socket, e.g. an hexagonal socket 23, for receiving a tightening key, is tightened. The pinion-hub 1 has a conical gear 3, preferably with straight teeth, with which the conical pinions 5, 5', . . . at the base of as many blades 4, 4', . . . of the propeller planetarily mesh. Preferably the propeller has three blades, meshing at an interval of 120° on the circumference of the conical gear 3 of the pinion-hub 1. The blades are journally mounted through holes 6*a*, 6*a'*, . . . of as many sectors or portions 6, 6', . . . , of casing which are joined together by means of tangential stud bolts 19 to form a hollow casing housing the planet gear.

Each blade is pre-assembled on its respective sector of casing. To this end, each blade is provided with a cylindrical seat 4*a* formed at the base of the blade casting and a threaded blind hole 4*b*, coaxial with said cylindrical seat 4*a* and extending inside the body of the blade beyond the bottom of the seat 4*a*. The respective planet pinion 5 of the blade is provided with a bored cylindrical stem 5*a* which fits through the hole 6*a* of the respective sector of the casing and inside the seat 4*a* formed in the base portion of the blade 4. A stud screw 5*c* passes through the pinion 5, the stem 5*a* and tightens in the threaded hole 4*b* extending inside the body of the blade 4. Suitable setscrews 5*d* may be used for preventing loosening of the assembly.

The flexural forces acting on the blade are transmitted to the body of the relative sector of the casing and distributed uniformly on the tangential stud bolts 19. This readily improves the noise and vibratory characteristics of the impeller. Moreover the use of separate planet gears, on the stem of which are mounted the blades of the propeller, permits a more rational and precise machining of the gear for reducing clearances and further improving noise and vibratory characteristics of the assembly.

Rotation is transmitted by the pinion-hub 1 to the casing supporting the blades which is formed by the union of the sectors 6, 6', . . . by means of at least a tooth or circular sector 8 projecting from the external cylindrical wall of a thimble 11, which has an external broaching 13 meshing with an internal broaching 12 present on the end portion of the pinion-hub 1. The dragging tooth 8 cooperates with a circular sector or tooth 7' extending for a certain arc length and projecting from the internal wall of one (6') of the sectors of the casing. According to a feature of the propeller of the invention, this cooperating sector 7' is in the form of a separate insert piece having the shape of a sector of a circular ring with a rectangular or trapezoidal cross section and which is housed in a rectangular or trapezoidal cross section seat or groove 7*a* formed on the internal wall of one (6') of the sectors forming the casing. Both ends of the ring sector 7' have the inner portion, protruding out of the seat formed in the casing, extended circumferentially so as to create two spaces or seats underneath, respectively 7c and 7d, into which resilient inserts 7e and 7f of rubber (or calibrated springs) fit. The ring sectors 7' and the resilient inserts 7e and 7f are set into the seat 7a and are laterally held in place by the coupling surface of the adjacent sectors of casing (6 and 6''). If a rectangular cross section ring sector 7' is used, a retaining screw may be used, the stem and head of which may fit through a ledged slotted hole purposely made through the thickness of the ring sector 7' for preventing it from falling out of the seat 7a. As it may be easily understood by looking at the figures, the circular sector or tooth 8, solidly connected to the pinion-hub 1, when the latter rotates, eventually abuts against the stop surface of the relative end of the ring sector 7' protruding out of the seat 7a and which is solidly connected to the hub's casing formed by the sectors 6, 6' and 6''. The tooth 8 thus drags in rotation the casing and the blades 4, 4' and 4'', which, by being individually engaged through the conical planet gear with the conical gear 3 of the pinion-hub 1, will have meanwhile reached a certain limit orientation by having rotated about the axis of their pinion and planetarily about the hub's axis, thus determining the pitch. Similarly, by inverting the sense of rotation of the drive shaft 2 (e.g. reverse gear) the two drag teeth 7' and 8 will abut one against the other with their opposite end surfaces after the planet gear will have rotated by a certain angle thus reversing the orientation of the blades in respect to the axis of the propeller.

Therefore the orientation of the blades in respect to the propeller's axis under forward and reverse gear is determined by the relative angular position of the two circular sectors or teeth 7' and 8 for a certain relative assembly angle of meshing of the blade's pinions on the pinion-hub conical gear 3.

When the shaft 2 is stopped, e.g. when the boat is moving under sail, the blades 4, 4' and 4'' under the effect of the hydraulic pressures caused by the dragging of the blades through the water, are free to rotate about their own axis, by "rolling" with their planet pinion around the conical gear 3 of the pinion-hub 1. Therefore the blades yield under the pressure by orienting themselves so as to reduce the drag resistance. In this way, i.e. by feathering under the hydraulic drag pressure, the propeller blades assume a "flattened" position, i.e. with their major surfaces substantially parallel to the axis of the propeller, corresponding to a mid position in respect to the two limit orientations assumed by the blades, i.e. under forward and reverse driving of the propeller's shaft. These limit orientations of the blades are determined by the relative angular position of the two circular sectors 7' and 8, as seen before.

Upon the starting of engine propulsion of the boat and upon each reversal of rotation, the pinion-hub 1 rotates the thimble 11 and the blades 4, 4', . . . , about the axis of their respective planet pinion 5, 5', . . . , until the relative end of the circular sector 8 abuts against the relative end of the circular sector 7' inserted in the seat 7a' thus dragging into rotation the casing and the blades so oriented. The ramming together of the two ends of the circular sectors 8 and 7' is dampened by either one or the other of the two resilient inserts 7e and 7f. In this manner the intensity of the rammings is reduced and the abutment surfaces are less subject to deformation and the propeller becomes less noisy.

According to another aspect of the invention, the thimble 11 is essentially tubular and has an internal diameter sufficiently large for allowing the passage through the thimble of the locking nut 22 of the pinion-hub 1 on the conical end 20 of the drive shaft 2. The locking nut 22 tightens on the threaded end 21 of the shaft. The tubular thimble 11 is threaded at one end 11a and passes through the central hole of a flange 9a which is fixed by stud screws 9b to the end faces of the sectors 6, 6', . . . , of the hub's casing of the propeller. On the threaded end 11a of the thimble 11, a first tubular, truncated, ogive piece 9c is screwed and locked by means of setscrews 9d. An ogive shaped cap 9e is screwed into the threaded hole of the truncated ogive piece 9c, thus completing the ogive terminal of the propeller. A spring 17 is inserted over the tubular thimble 11 and abuts compressively against the internal surface of the flange 9a and keeps the thimble 11 engaged through the broached joint 12–13 with the pinion-hub 1.

The propeller may be dismantled and mounted on the drive shaft without disassembling it. To do this it is sufficient to unscrew the cap 9e and to insert a key to engage the socket-head seat 23 on the locking nut 22 and to unscrew the latter completely thus freeing the propeller from the drive shaft.

The pitch may be varied without disassembling the propeller and without any tool. For varying the pitch it is sufficient to manually pull the portion of the casing (7) represented by the ogive terminal, formed by the truncated ogive piece 9c and by the cap 9e, against the resistance of the push-back spring 17 until disengaging the thimble 11, which is connected to the ogive terminal 7, from engagement with the pinion-hub 1 and to rotate the pulled out ogive by a certain angle before releasing the pull and letting the thimble 11 engage again with the pinion-hub 1 in a changed relative angular position. The minimum increment of variation will be unitarily determined by the pitch of said external and internal broachings 12 and 13, telescopically meshing together.

The external surface of the ogive terminal may be conveniently provided with grasps indentations or tangential grooves for facilitating the pulling action.

The pitch adjustment operation is extremely simple and rapid and may be performed by a short immersion.

Pitch adjustment may be facilitated by means of a scale or reference marks engraved along the adjacent external rims of the flange 9a and of the truncated ogive piece 9c.

Normally the construction material will be marine bronze with the exception of the ogive cap 9e, which will be preferably made of zinc or of another metal more electropositive than bronze in order to sacrificially protect the bronze from corrosion.

The interior of the hub's casing may be substantially sealed for more effectively retaining a water resistant lubricating grease by employing suitable sealing rings (O-ring) and gaskets of "Viton" between coupling surfaces of the various components which form the propeller and which enclose the described mechanisms.

Figure 3:
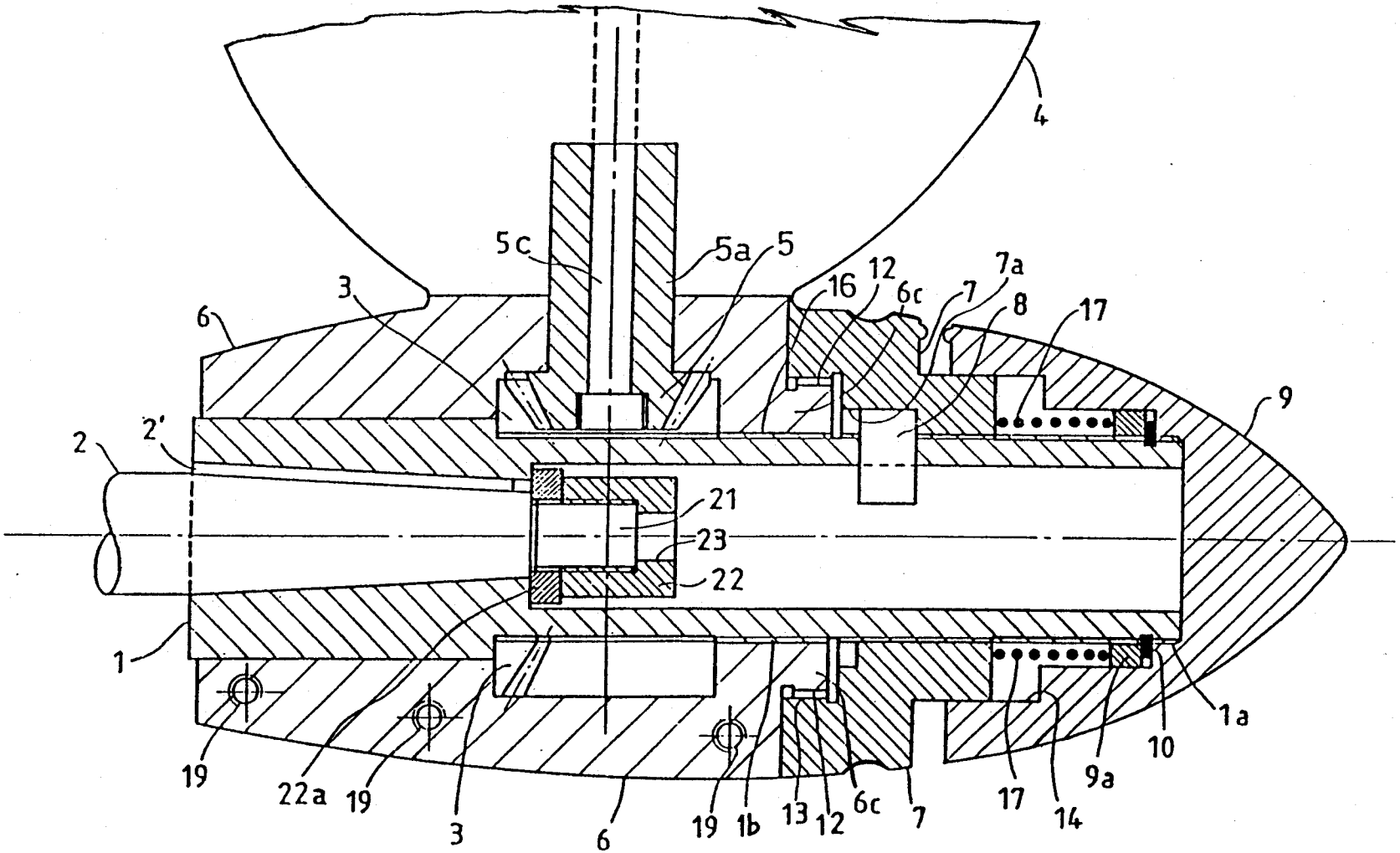
FIG. 3 is a partial schematic sectional view of a propeller according to a different embodiment of the invention.

In the embodiment depicted in FIG. 3, the propeller comprises a hub 1, keyed by means of the key 2' on the drive shaft 2. The coupling is locked by the locking nut 22 screwed on a threaded end 21 of the drive shaft and tightened on an elastic washer 22a. The locking nut is conveniently provided with a socket 23 for a tightening key. The hub 1 has a tubular extension la, the outer surface of which is broached (i.e. has longitudinal parallel teeth 1*b* cut thereon). Over this externally broached surface of the hub extension a first conical gear 3 may be heat-set or locked by means of suitable setscrews. On this conical gear 3 mesh the planet pinions 5 of the blades 4 of the propeller. The planet pinion 5 of each blade has an internally bored stem 5*a* which fits in a housing formed at the base of the blade and the assembly is mechanically connected by means of a stud screw 5*c* passing through the central bore of the stem 5*a* of the planet pinion and screwing inside a threaded hole formed inside the body of the blade 4. Each stem 5*a* rotatably passes trough a hole formed through the wall of a respective sector of the hub's casing 6 which is formed by joining together a number of sectors by means of tangential stud bolts 19. The end facing the ogive terminal of the propeller of this first portion of casing 6 has a reduced-diameter tubular extension 6*c*, the external cylindrical surface of which has an external broaching 12. This first portion 6 of the casing is essentially rotatable in respect to the hub 1 keyed on the drive shaft 2.

The hub's casing comprises an essentially tubular second portion 7, which telescopically meshes by means of an internal broaching with said reduced-diameter externally broached extension 6*c* of the first portion of the casing. This second portion 7 of the casing has the internal wall provided with a seat circularly extending for a certain arc of circumference (or equivalently with two angularly spaced stops) in order to provide two circumferentially spaced stop surfaces for a dragging tooth or sector 8 which is essentially connected to the tubular extension 1*a* of the hub 1. Upon rotation of the drive shaft 2 and of the hub 1, each blade of the propeller rotates about the axis of its planet pinion 5 meshing with the conical gear 3 of the hub 1, until the rotation of the hub brings one end of the sector 8 to abut against one or the other of said stop surfaces present on the internal wall of the tubular portion 7 of the casing. At this point the casing, formed by the two portions 6 and 7 telescopically meshing together by means of the joint 12–13, is dragged into rotation and with it are the blades of the propeller in the limit orientation which they have assumed and which determines the pitch of the propeller.

The telescopic meshing between the two portions of casing 6 and 7 is maintained by a push-back spring 17 which is compressed between a terminal face of the tubular portion 7 of the casing and a stop ring 9*a* held by means of a Seeger ring 10 on the external surface of the end of the extension 1*a* of the hub. The spring 17 is housed inside a cavity defined by an ogive terminal 9 which may be screwed on or otherwise fixed to the end of the hub extension 1*a*. As shown in FIG. 3, the terminal part 14 or base of the ogive terminal 9 may be conveniently machined in order to telescopically fit over the end of the tubular portion 7 of the casing.

The tubular portion 7 of the casing may be pulled manually toward the ogive terminal of the casing in opposition to the force exerted by the spring 17 for a distance sufficient to disengage the external broaching 13 from the internal broaching 12 on the end of the portion 6 of the casing and rotated relatively to the latter thus modifying the relative angular position of the stop surfaces present on the internal surface of the tubular portion 7 of the casing in respect to the sector 8 and to the whole planet-gear assembly, thus altering the pitch of the propeller.

Again the pulling out and rotation of the tubular portion 7 of the casing may be facilitated by forming suitable grip indentations (not shown in the figures) on the external surface of it.

Figure 4:
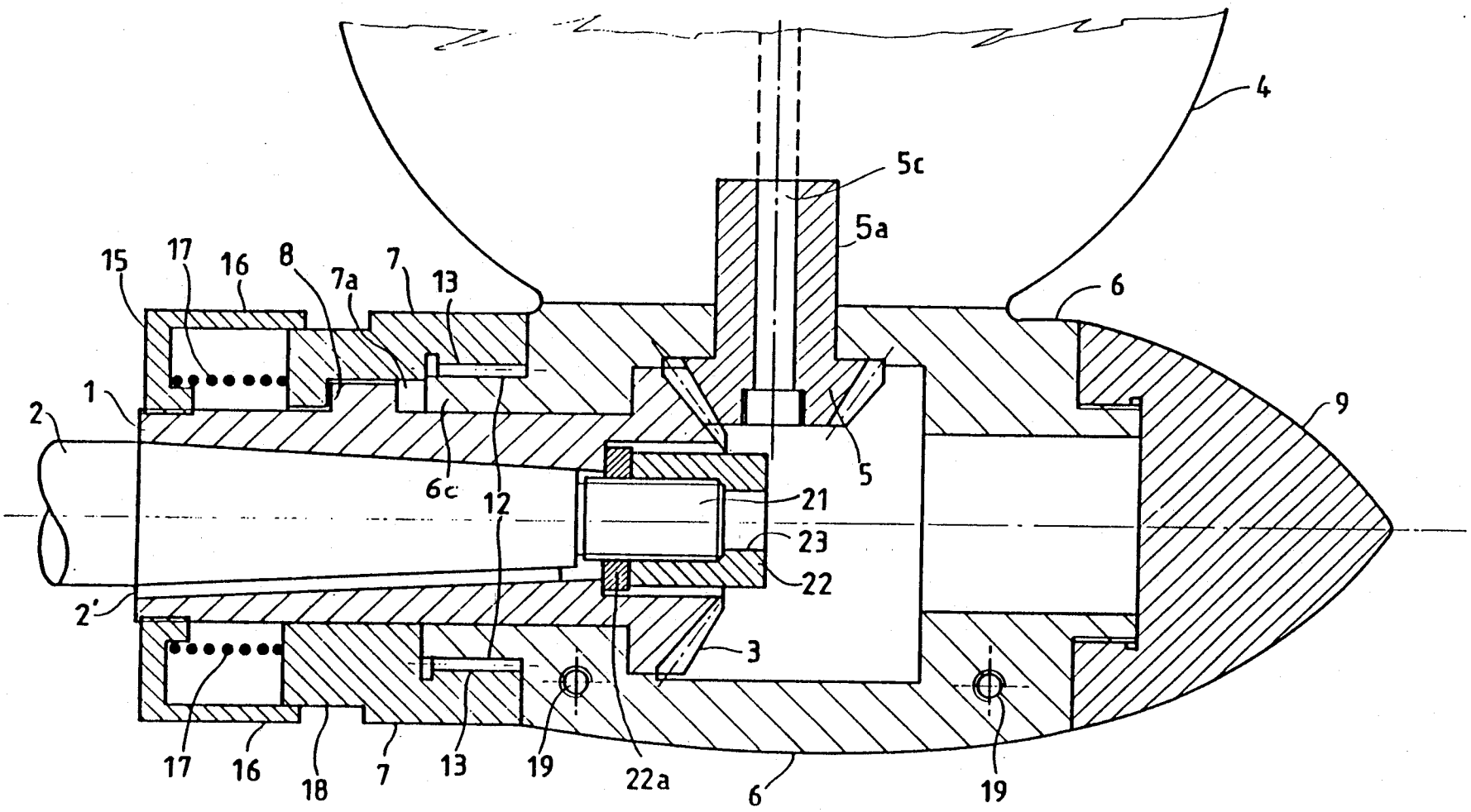
FIG. 4 is a partial schematic sectional view of a propeller of the invention according to another alternative embodiment.

A further embodiment is depicted in FIG. 4.

For brevity's sake, the same functional parts of the propeller are indicated in FIG. 4 by the same numbers used in FIG. 3 for indicating identical or functionally equivalent parts and a repeated description is deemed unnecessary.

In the embodiment of FIG. 4, the propeller's hub 1 has not the cylindrical extension toward the ogive terminal of the propeller as in the previously described embodiments and the dragging tooth or sector 8 is formed directly on the external surface of the hub 1 by machining. In this case also the conical gear 3 of the hub may be obtained by machining the end portion of the hub 1.

The ogive terminal 9 is in this case directly screwed on a threaded end of the first portion 6 of the hub's casing.

The second tubular portion 7 of the casing telescopically meshes by means of an internal broaching 13 with an external broaching 12 formed over the external surface of a reduced-diameter end of the first portion 6 of the casing facing toward the drive shaft 2 and the second portion 7 is held engaged thereon by the push-back spring 17.

Similarly to what described before in relation to FIG. 3, on the internal wall of the portion 7 of the casing there are two stop surfaces (not shown in the figure), circumferentially separated by a certain arc of circumference and which may be formed as in the case shown in FIG. 3, by machining a seat 7*a* extending for a certain arc of circumference and capable of accommodating the travel of a dragging tooth or sector 8 integral with the hub 1 of the propeller and which is free to rotate from one end to the opposite end of the seat 7*a*.

The push-back spring 17 abuts against the surface of a flange body 15 which may be screwed on a threaded end of the hub 1 toward the drive shaft 2. The flange body 15 is provided with a tubular extension 16 which telescopically fits over a purposely reduced-diameter end 18 of the second portion 7 of the casing.

Also in this embodiment the tubular portion 7 may be pulled out of engagement through the joint 12–13 with the portion 6 of the casing and rotated relatively to the latter and to the hub 1 by manually grasping the outer surface thereof and pulling it in opposition to the spring 17 in order to modify the pitch of the propeller.

The stated objectives are fully met by the propellers of the invention. Moreover the two alternative embodiments depicted in FIGS. 3 and 4 have the additional advantage of requiring a minimum number of parts and are exceptionally suited for propellers of small and medium dimensions.

Of course suitable reference marks may be engraved on the external surfaces of the two portions 6 and 7 of the casing, along the perimeter of their respective coupling faces, for facilitating pitch adjustment. Furthermore "O-ring" seals may be employed for sealing the interior of the casing housing the described mechanisms for a better retention of a water resistant lubricating grease.

Also in the two last embodiments depicted in FIGS. 3 and 4, resilient inserts will be preferentially used on abutment surfaces of the dragging tooth or sector 8 and/or on abutment stop surfaces of the seat within which the sector 8 travels.

I claim:

1. A device for varying the pitch of a feathering propeller utilizing a planet gear between blades of the propeller and a hub thereof for determining a free rotation of said blades about their respective axis for an angle set by stop means of a relative rotation between a hub's casing having holes through which said blades are journally mounted and said hub, keyed to a drive shaft of the propeller and said stop means determining a limit orientation assumed by the blades under a two opposite conditions of hydraulic forces acting on them in a forward and reverse sense of rotation of the drive shaft, without dismantling the propeller, characterized by the fact that said casing is formed by at least two portions telescopically meshed one with the other;

a first portion of the casing is essentially rotatable about said hub and is provided with holes through which the blades are rotatably held in a planetary engagement with said hub;

a second portion of the casing is provided on an internal surface thereof with two abutment stop surfaces circumferentially spaced among each other to confine the travel of a dragging tooth or sector fitting therebetween and rigidly connected to said hub;

said second portion of the casing being capable of being pulled telescopically away from said first portion of casing against the resistance of a push-back spring for a distance sufficient to disengage a telescopically meshing joint formed by an external broaching present on a reduced-diameter end of one of said two portions of casing and an internal broaching present in the coupling end of said other portion of the casing, rotated relatively to said first portion of casing and released for re-engaging of the two portions of casing in a different relative angular position, thus changing the relative angular position of said stop surfaces in respect to said tooth or sector and thus changing the pitch of the propeller by a minimum unitary increment which is determined by the pitch of said telescopically meshing together external and internal broachings.

2. The device according to claim 1, wherein said second portion of the casing telescopically couples with said first portion of the casing from the side of the drive shaft adjacent the propeller and can be telescopically pulled out of engagement with said first portion of the casing by pulling it axially toward the drive shaft in opposition to a push-back spring retained by a tubular flange body mounted on the end of said hub, which is keyed on the end of said drive shaft, said flange body having a tubular extension housing said push-back spring and telescopically accommodating a reduced-diameter tubular end of said second portion of the casing.

3. The device according to claim 1, wherein said second portion of the casing telescopically couples with said first portion of the casing from the opposite side of the drive shaft and may be pulled out of engagement with said first portion of the casing by pulling it axially against the resistance of a push-back spring which is retained by an ogive-shaped terminal of the casing mounted on a threaded tubular extension of said hub.

4. The device according to claim 1, wherein grip indentations are formed on the external surface of said second portion of the casing for manually exerting said pulling action followed by said rotation action for modifying the pitch of the propeller.

5. The device according to claim 1, wherein reference marks are engraved on the external surfaces of said two portions of the casing near the external rim of the coupling faces thereof for facilitating pitch adjustment.

6. A variable pitch feathering propeller for sailing boats comprising a pinion-hub permanently keyed on an end of a drive shaft and locked thereon by a locking nut screwed on a threaded end of the shaft and having a coaxial conical gear; at least two blades each having a conical pinion end planetarily engaged with said conic gear of said pinion-hub, each of said blades being free to rotate about the axis of its pinion end and around said conic gear of said pinion-hub starting from a neutral position of the blade with its major surfaces substantially parallel to the shaft's axis, through two opposite angles set by stop means, when urged by hydraulic forces caused, respectively, by the rotation in a forward and in a reverse sense of said drive shaft which determines the pitch of the propeller in the two senses of rotation and from either of two limit positions toward said neutral position when urged by the hydraulic forces caused by drag forces when the propeller is dragged through water;

at least two sectors joined together to form a casing enclosing said pinion-hub (1) and the planet pinion ends of said blades, said casing being free to rotate about said pinion-hub within said two opposite angles which are set by means of at least a first tooth or sector solidly connected to said casing and a second tooth or sector solidly connected to said pinion-hub cooperating with each other for determining said stop means in the two senses of rotation of the blades around their own axis and planetarily around said pinion-hub and for dragging into rotation said casing and said blades under the action of the drive shaft;

said sector being formed on an external cylindrical surface of a thimble having a broached tubular end meshing with a broached cylindrical end of said pinion-hub in a relative angular position therebetween which determines a certain pitch of the propeller, characterized by the fact that each of said sectors has a cylindrical hole and each blade is preassembled on a respective sector by means of a respective conical pinion having a bored stem rotatably held in said hole and rigidly fitted into a seat formed at the base of the blade by means of a stud screw passing through a central bore of said pinion and screwed inside a threaded hole extending from said seat inside the body of the blade;

said thimble is tubular and an end opposite to said broached end is connected to a first truncated portion of an ogive-shaped terminal of the casing by passing through an annular flange connected to the end face of said casing, a push-back spring fitting over said tubular thimble and abutting compressively against the internal surface of said annular flange to keep said thimble engaged with said pinion-hub;

a threaded ogive-shaped cap is screwed into a central threaded hole of said first truncated ogive portion;

the pitch being variable by pulling said ogive-shaped terminal formed by said first truncated portion and by said cap against the resistance of said spring until disengaging said thimble from said pinion-hub, rotating by a certain angle the pulled-out ogive terminal and releasing the latter for re-engaging the thimble on the pinion-hub in a varied relative angular position; and the propeller being dismantleable from said drive shaft by unscrewing said cap, inserting a key into and unscrewing said locking nut, freeing the propeller from the drive shaft.

7. The propeller according to claim 6, wherein said sector solidly connected to said casing is formed by a ring sector insert having a rectangular or trapezoidal cross section, housed in an arc of circumference seat present on the internal wall of one of said sectors composing said casing and confined therein by means of resilient end inserts restrained by the coupling surfaces of two sectors of casing adjacent thereto for dampening ramming.

8. The propeller according to claim 7 wherein said resilient inserts are blocks of rubber held at the two ends of said arc of circumference seat under respective extensions of said ring sector insert salient in respect to the surface of said internal wall.

* * * * *